United States Patent [19]

Feilmeier et al.

[11] Patent Number: 5,063,483

[45] Date of Patent: Nov. 5, 1991

[54] BATTERY POWERED LIGHT WITH MOUTHPIECE

[76] Inventors: John Feilmeier; Rosemary Feilmeier, both of 3136 S. Lakeport Rd., Sioux City, Iowa 51106

[21] Appl. No.: 603,389

[22] Filed: Oct. 26, 1990

[51] Int. Cl.[5] ..... F21L 15/08

[52] U.S. Cl. ..... 362/103; 362/108; 362/190; 362/191

[58] Field of Search ..... 362/103, 804, 190, 108, 362/191

[56] References Cited

U.S. PATENT DOCUMENTS

| | | | |
|---|---|---|---|
| 1,166,495 | 1/1916 | Tizzard | 362/103 |
| 1,844,588 | 2/1932 | Meitzler | 362/804 |
| 2,244,288 | 6/1941 | Colby | 362/191 |
| 2,299,467 | 10/1942 | Colby | 362/190 |
| 2,710,338 | 6/1955 | Svalgaard | 362/108 |
| 3,225,982 | 12/1965 | Melton | 362/108 |
| 3,418,461 | 12/1968 | Sedlock | 362/191 |
| 4,893,221 | 1/1990 | Friedman | 362/108 |
| 4,974,130 | 11/1990 | Friedman | 362/191 |
| 4,984,724 | 1/1991 | Johnson | 362/108 |

FOREIGN PATENT DOCUMENTS

| | | | |
|---|---|---|---|
| 128155 | 1/1901 | Fed. Rep. of Germany | 362/103 |

*Primary Examiner*—Ira S. Lazarus
*Assistant Examiner*—Y. Quach
*Attorney, Agent, or Firm*—H. Jay Spiegel

[57] ABSTRACT

The battery powered light with mouthpiece includes the combination of an illuminating means and a mouthpiece. In use, a user can hold the illuminating means by gripping the mouthpiece and direct the light source in a particular manner. The combination of an illuminating means and a mouthpiece permits the illuminating means to be used while the hands of a user are free to perform specific tasks.

6 Claims, 1 Drawing Sheet

BATTERY POWERED LIGHT WITH MOUTHPIECE

BACKGROUND OF THE INVENTION

The present invention relates to a battery powered light with a mouthpiece. The battery powered light and mouthpiece permits a user to direct the battery powered light while having both hands free for use. In the prior art, flashlights that are hand-held or body-mountable are known. U.S. Pat. No. 4,916,596 to Sharrah et al. discloses a flashlight that is convertible between a hand-held form and a body-mountable form. In the body-mountable form, the flashlight may be mounted about a user's head.

U.S. Pat. No. 1,266,659 to Brannan discloses an illuminating tooth clamp which may be detachably applied to a tooth of a patient during the performance of dental work.

Applicants are unaware of any prior art, including the two patents cited above, which teach or fairly suggest the combination of a battery powered light and a mouthpiece such that the battery powered light may be held by a user gripping the mouthpiece.

SUMMARY OF THE INVENTION

The present invention relates to a battery powered light with mouthpiece. The present invention includes the following interrelated aspects and features:

A) The battery powered light with mouthpiece includes a battery powered light which has attached thereto a mouthpiece which permits a user to hold the battery powered light in a user's mouth, thereby permitting both hands of the user to be free.

B) The battery powered light includes a housing for storing the power source for the light and a reflector surrounding a light bulb for directing the light in a more focused manner.

C) The housing also includes an on-off switch as well as a compartment door for accessing the power source for the light.

D) The battery powered light with mouthpiece may also include a cord to permit the device to be supported around a user's neck when not in use.

Accordingly, it is a first object of the present invention to provide a battery powered light with mouthpiece.

It is a yet further object of the present invention to provide a battery powered light with mouthpiece which permits a user to hold the battery powered light by a user's teeth gripping the mouthpiece.

It is a still further object of the present invention to provide a battery powered light with mouthpiece which frees a user's hands to be used without having to hold the illuminating means.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
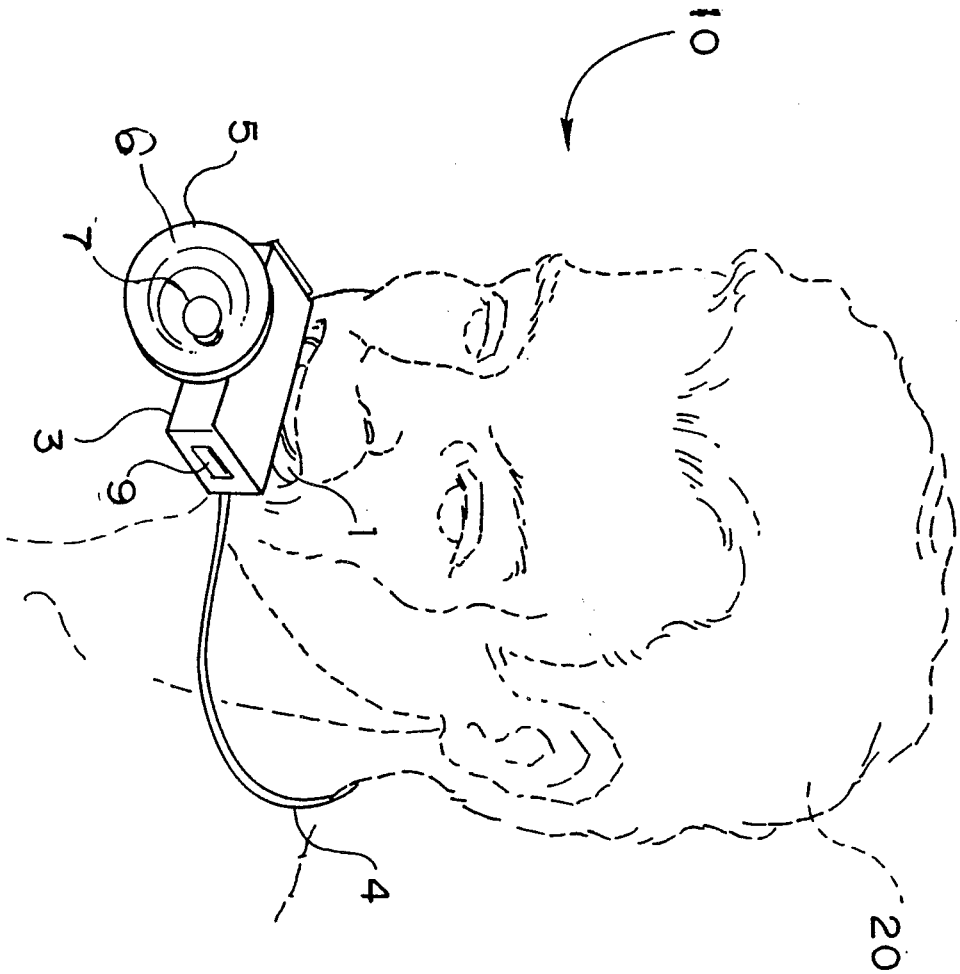
FIG. 1 shows a perspective view of an exemplary use of the inventive device.

With reference to FIG. 1 firstly, the battery powered light with mouthpiece is generally designated by the reference numeral 10 and is seen to include a mouthpiece 1 being held in the mouth of a user 20 and being attached to an illuminating means 2. The illuminating means 2 is seen to include a housing 3 for storing a power source therein, and illumination means consisting of a reflector 5 having a reflective coating 6 thereon and a light bulb 7 located within the reflector 5. The reflector coating 6 is designed to enhance the illumination of the light bulb 7 during use.

The housing 3 also includes an on-off switch 9 which controls the function of the light bulb 7. It should be understood that the electrical circuitry contained within the housing 3 to operate the light bulb 7 is considered to be well known in the prior art and, thus, is not considered an aspect of the present invention.

The housing 3 may be designed to store batteries to operate the light bulb 7, with a preferred set of batteries including two AA batteries to provide the proper balance between sufficient power to illuminate the light bulb and light weight to permit the illuminating means to be held within a user's mouth by means of the mouthpiece 1.

The inventive device may also include a cord means 4 which is designed to encircle a user's head such that the device may be held around the neck of a user while not in use.

Figure 2:
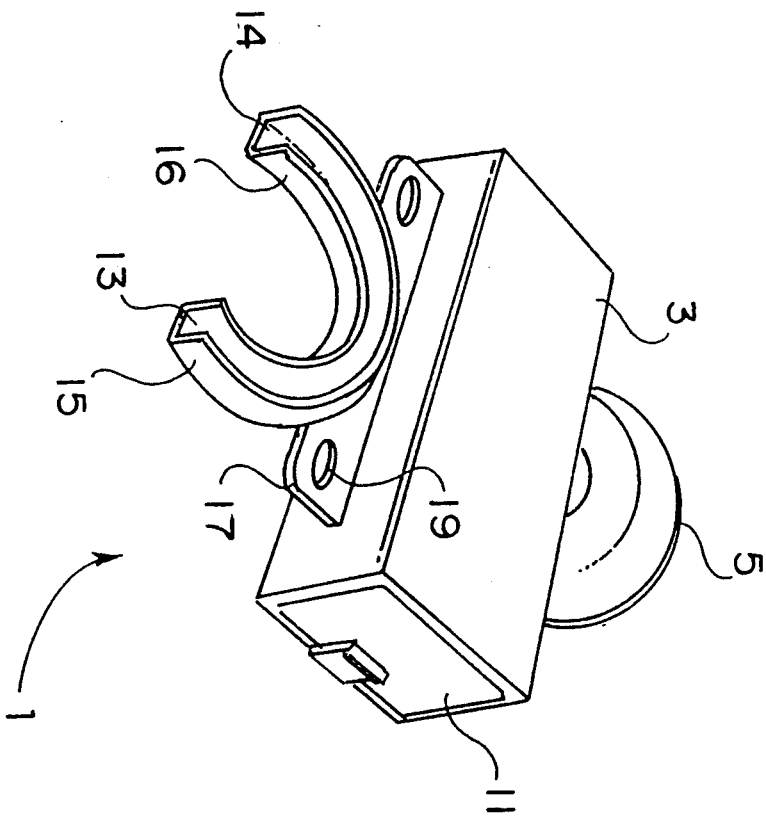
FIG. 2 shows a rear perspective view showing the mouthpiece in greater detail.

With reference to FIG. 2, the mouthpiece 1 is shown in greater detail attached to the rear of the housing 3. The mouthpiece 1 is generally semi-circular in shape so as to conform to the configuration of a user's teeth and bite. The mouthpiece 1 includes outer member 15, inner member 16 and base member 14 which form a channel 13 which is designed to receive and engage a user's teeth when a user is clamping down on the mouthpiece to hold the inventive device. The mouthpiece 1 may be made of a resilient material which will permit a user to bite into the mouthpiece without discomfort on a user's gums or teeth.

The mouthpiece 1 may be attached to the housing 3 in any known conventional manner. The mouthpiece 1 may also have as a part thereof cord attachment means consisting of a pair of wings 17, each wing 17 having an opening 19 therein. The opening 19 is used to attach the cord means 4 to the inventive device for purposes as set forth hereinabove. Alternatively, the wings 17 may be made a part of the housing 3 with the mouthpiece 1 being attached to the housing 3 as well as the wings 17. The housing 3 may also include a cover 11 which facilitates removal and replacement of the batteries located in the housing 3.

The housing 3 may be made out of any material with a plastic material being preferred. The light bulb 7 may be a Krypton light bulb so as to provide the maximum illumination during use. The cord means 4 may be made of any material with an elastic material being preferred for use. The cord means may be attached to the opening 19 in the wings 17 in any conventional manner such as clips, knotted cord ends or the like.

The present invention provides improvements over other prior art devices in that a user may aim or direct a small illuminating means held in a user's mouth, thereby freeing both hands for performing tasks such as changing a flat tire or the like.

As such, an invention has been disclosed in terms of a preferred embodiment thereof which fulfills each and every one of the objects of the invention as set forth hereinabove and provides a new and improved mouth-held battery powered light of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

We claim:

1. A light comprising:

a) a housing containing a power source and illumination means selectively electrically connectable to said power source;

b) a mouthpiece connected to said housing and including a curved channel generally conforming to a user's bite and adapted to receive said user's teeth therein; and c) cord attachment means interposed between said mouthpiece and housing for attaching a cord thereto.

2. The invention of claim 1, wherein said illumination means comprises a reflector attached to said housing and a light bulb mounted in said reflector.

3. The invention of claim 1, wherein said mouthpiece is made of resilient material.

4. The invention of claim 1, wherein said power source comprises a battery.

5. The invention of claim 1, wherein said cord attachment means comprises a pair of wings, each wing having an opening therethrough.

6. The invention of claim 5, further including a cord having a first end attached at one of said openings and a second end attached at another of said openings.

* * * * *